United States Patent [19]

Tange et al.

[11] Patent Number: 4,945,388

[45] Date of Patent: Jul. 31, 1990

[54] METHOD AND APPARATUS FOR CLEANING A COLOR IMAGE FORMING APPARATUS BY STICKING DEVELOPER ON THE PHOTOCONDUCTOR WITHOUT FORMING AN IMAGE

[75] Inventors: Keigo Tange; Tomohisa Kanada; Shingo Hirota, all of Osaka, Japan

[73] Assignee: Minolta Camera Kabushiki Kaisha, Osaka, Japan

[21] Appl. No.: 409,302

[22] Filed: Sep. 19, 1989

[30] Foreign Application Priority Data

Sep. 20, 1988 [JP] Japan ..... 63-237140

[51] Int. Cl.[5] ..... G03G 21/00; G03G 15/01

[52] U.S. Cl. ..... 355/296; 355/299; 355/327; 118/652; 430/125

[58] Field of Search ..... 355/296, 299, 208, 306, 355/326, 327, 269; 118/652; 15/256.51, 256.52; 430/125

[56] References Cited

U.S. PATENT DOCUMENTS

| | | | |
|---|---|---|---|
| 3,649,262 | 3/1972 | Cade et al. | 430/125 X |
| 3,910,231 | 10/1975 | Inoue et al. | 355/327 X |
| 4,396,276 | 8/1983 | Murasaki | 355/299 |
| 4,711,555 | 12/1987 | Toshimitsu et al. | 355/299 |

FOREIGN PATENT DOCUMENTS

| | | | |
|---|---|---|---|
| 2950769 | 6/1981 | Fed. Rep. of Germany | 355/296 |
| 51-1130 | 1/1976 | Japan . | |
| 55-89882 | 7/1980 | Japan . | |
| 57-204576 | 12/1982 | Japan . | |
| 0204577 | 12/1982 | Japan | 355/299 |
| 63-25354 | 5/1988 | Japan . | |
| 0202782 | 8/1988 | Japan | 355/299 |
| 1321651 | 6/1973 | United Kingdom . | |

*Primary Examiner*—Arthur T. Grimley
*Assistant Examiner*—William J. Royer
*Attorney, Agent, or Firm*—Burns, Doane, Swecker & Mathis

[57] ABSTRACT

A developing unit which accommodates black toner is operated for developing process by black toner only at a proper time when color image forming operation is not performed by other developing units which accommodate other colored toners. Then, a cleaning blade is actuated without conducting transfer process of the developed image onto a transfer material, and residual toner is removed from the photoconductor.

29 Claims, 5 Drawing Sheets

METHOD AND APPARATUS FOR CLEANING A COLOR IMAGE FORMING APPARATUS BY STICKING DEVELOPER ON THE PHOTOCONDUCTOR WITHOUT FORMING AN IMAGE

BACKGROUND OF THE INVENTION

1. Technical Field of the Invention

The present invention relates to a colored image forming apparatus such as color copying machine and color printer which is provided with developing units for use with colored toners other than black in addition to a developing unit which is used for black toner.

2. Description of Related Art

In a colored image forming apparatus, an electrostatic latent image which is to be developed by a predetermined color is formed on a photoconductor by optical system of copying machine or printer. Then, the electrostatic latent image is developed by a developing unit which accommodates a predetermined colored toner to be used for development. The developed image after development is transferred onto a transfer material, intermediate transfer belt or the like on the photoconductor. Thereafter, an electrostatic latent image which is to be developed by next predetermined color is formed on the photoconductor by optical system. The electrostatic latent image thus formed is developed by a developing unit which accommodates the next predetermined colored toner to be used for development. The developed image thus obtained is transferred onto the transfer material, intermediate transfer belt or the like on the photoconductor by overlaying it on the image previously transferred. After each transfer process, the developer remained on the photoconductor is cleaned by a cleaning device.

However, when colored toners other than black toner are cleaned, residual developer on the photoconductor is not well cleaned compared with the case when black toner is cleaned, and it causes to readily produce filming on the photoconductor by colored toners other than black toner. The cause is not known yet, however, it may be attributed to dye or pigment which is a component of toners. A resin of low melting viscosity is often used for colored toners other than black toner in order to produce clearer color and also to have satisfactory permeability when image is transferred onto a sheet used for overhead projectors. In this case, however, it tends to further deteriorate cleaning capability.

Japanese Patent Publications TOKKO SHO No. 51-1130, TOKKAI SHO No. 57-204576 and TOKKAI SHO No. 55-89882 disclose ideas to solve these problems.

In the first publication, there is disclosed an idea for improving toner cleaning efficiency by mixing toner with small amount of low adhesive polymeric additive in smaller average particle size than that of the toner of each developer. In the second publication, an idea is disclosed wherein each developer is mixed with an abrasive for removing a matter adhered to the photoconductor when cleaning process is conducted. In the third publication, there is disclosed an idea for removing a matter adhered to the photoconductor with said resin by providing a grinding device aside from a cleaning device.

However, in the colored image forming apparatus, it takes labors to mix proper amount of suitable polymeric additive or abrasive with each developer and it eventually becomes expensive. Moreover, it is not preferable for use in forming a colored image which requires delicate tone since it badly affects the clearness of color and permeability when the additive or abrasive are mixed with colored toner other than black toner.

SUMMARY OF THE INVENTION

A primary object of the present invention is to provide a colored image forming apparatus which is capable of improving reliability on image by effectively preventing filming on the photoconductor by colored toners other than black toner wherein special additive or abrasive is not necessary to be mixed with colored toner other than black toner, and special device such as grinding device is not necessary either.

The present invention has been brought about based on the knowledge of the inventors who studied to accomplish the above-mentioned object. That is a discovery that even there occurred filming on the photoconductor by colored toners other than black toner, a matter adhered to the photoconductor such as filming can be effectively removed if development is made by black toner and cleaning is conducted by the cleaning device without conducting transfer process. The reason why such sufficient cleaning can be made by use of black toner is not known clearly, however, it may be presumed that the carbon largely contained in black toner contribute to the cleaning efficiency.

In the present invention, there are provided developing units by which other colored toners other than black toner are used in addition to a developing unit by which black toner is used, and the developing units are selectively used every time when an electrostatic latent image to be developed in a predetermined color is formed to develop into a colored image wherein development by the developing unit in which black toner is used is carried out at proper time when colored image is not formed and the photoconductor is cleaned without performing transfer process which is the characteristic of the present invention.

According to the color copying machine of the present invention, developing process is carried out by only a developing unit in which black toner is used at a proper time when a colored image is not formed. Black toner is thus adhered to the surface of photoconductor. Then, the surface of the photoconductor is cleaned under the existence of black toner by the cleaning device without performing transfer process and a matter adhered to the photoconductor such as filming formed by colored toners other than black toner is removed together with black toner.

These and other objects and features of the present invention will become more apparent from the following description taken in conjunction with the accompanying drawings which illustrate specific embodiments of the invention.

BRIEF DESCRIPTION OF THE DRAWING

It is to be noted that like parts are designated by like reference numerals and marks throughout the accompanying drawings of each embodiment of the present invention and repeated description is omitted.

DESCRIPTION OF THE PREFERRED EMBODIMENTS

Embodiments of the present invention will now be described below referring to accompanying drawings.

Figure 1:
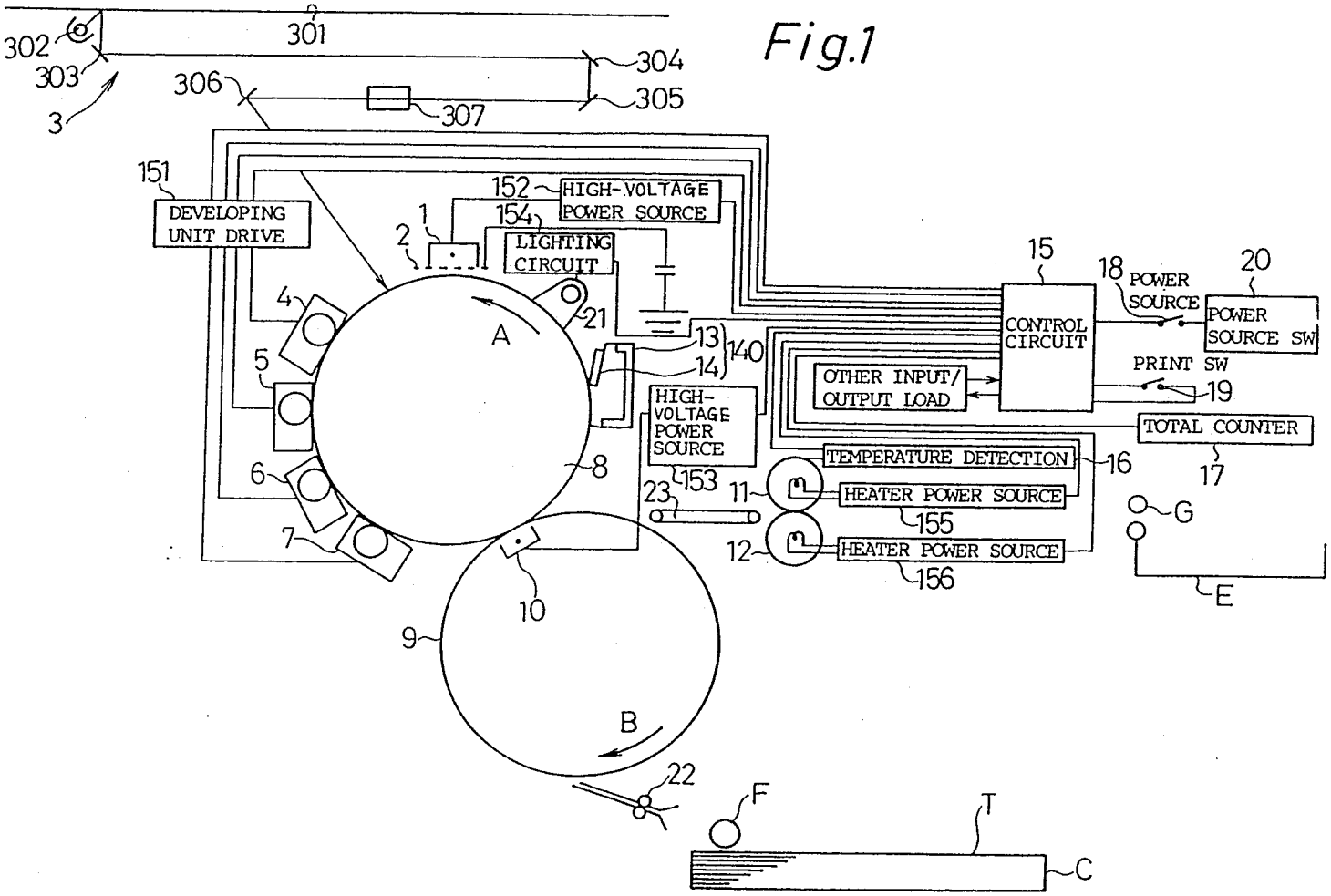
FIG. 1 is a schematic constructional view of the main part of a color copying machine to which the present invention is applied as one of embodiments.

FIG. 1 shows a schematic constructional view of the main part of a color copying machine to which the present invention is applied as one of embodiments.

The copying machine is provided with a photoconductive drum 8 in the central part, and the drum is rotatively driven in the direction of arrow A in the figure by an unillustrated driving means. Around the photoconductive drum 8, there are sequentially disposed a charger 1, developing units 4,5,6,7, a transfer charger 10, a blade-type cleaning device 140 and an eraser 21.

In the developing units 4,5,6, colored toners other than black toner are accommodated. More particularly, magenta toner is accommodated in the developing unit 4, cyan toner in the unit 5 and yellow toner in the unit 6 respectively. In the developing unit 7, there is accommodated black toner to which abrasive may be mixed. As the abrasive, the products such as follows may be named; i.e. ceria, silica, calcium carbonate, aluminum sulfate, barium sulfate, magnesium sulfate, aluminum oxide (alumina), strontium oxide and carborundum. Each toner is negatively charged against the electrifying polarity of charger.

The transfer charger 10 is accommodated in a transfer drum 9 which is provided with an unillustrated transfer material holding means.

Above the photoconductive drum 8, there are disposed an original glass table 301, an original illuminating lamp 302, an optical system 3 comprising of first to fourth mirrors 303–306 for scanning an original and projecting and exposing an image on the photoconductive drum 8 and a projection lens 307.

Under and on the side of the transfer drum 9, there is provided a paper feed cassette C. Transfer paper or transfer material T used for overhead projector accommodated in the cassette is sent out of the cassette C by paper feed rollers F and held on the drum 9 by an unillustrated holding means of the transfer drum 9 after paper feed timing is adjusted by a timing roller device 22.

Above the transfer drum 9, there are sequentially disposed a transfer belt 23 for transporting the transfer material conveyed from the transfer drum 9, fixing rollers 11,12 provided with heaters therein, discharge rollers G and a discharge tray E.

The cleaning device 140 includes a blade 14 which is pressed to come in contact with the surface of the photoconductive drum 8 to scrape off toner adhered to the surface of the drum 8.

The copying machine in this embodiment is controlled and operated by a control circuit 15 which is centered around a microcomputer. The output port of the control circuit 15 is connected to the developing units 4,5,6 and 7 through a developing unit driving circuit 151 and also to the charger 1 through a high voltage power source 152, the transfer charger 10 through a high voltage power source 153 and the eraser 21 through a lighting circuit 154 respectively.

The charger 1 is provided with a grid 2 which is maintained at a constant voltage.

The output port of the control circuit 15 is also connected with a heater in the fixing roller 11 through a heater power source 155 and a heater in the fixing roller 12 through a heater power source 156 respectively, and is further connected to a total counter 17 which is arranged for counting the total number of sheets copied.

To the input port of the control circuit 15, a power source 20 is connected through a power source switch 18, and a print switch 19 and temperature detector 16 of the fixing rollers 11,12 are also connected respectively. Input and output load of the optical system 3 and others are also connected to the control circuit 15.

Now, the operational action of the apparatus will be described below.

At the beginning, the power source switch 18 is turned on by which heaters in the fixing rollers 11,12 are turned on to start warming-up operation. During this warming-up operation, the photoconductive drum 8 is rotatively driven under a state that the original illuminating lamp is put off, and is electrified by the charger 1. At the same time, the developing unit 7 which accommodates black toner is only operated or bias voltage is applied between the photoconductive drum 8 in addition to the operation of the developing unit 7 thereby producing solid image of black toner on the photoconductive drum 8. At this stage, the photoconductive drum 8 is cleaned by the cleaning blade 14 without operating the transfer charger 10, and the eraser 21 is turned on according to requirement.

After the photoconductive drum 8 is scraped by the cleaning blade 14 for a predetermined period of time and when the temperature of the fixing rollers 11,12 detected by the detector 16 has reached a fixed temperature, the warming-up operation is completed to be ready for printing. At this time, a matter adhered to the drum 8 such as filming caused by colored toners other than black toner 8 is removed by the solid development of black toner and succeeding cleaning operation by the cleaning blade 14.

After the warming-up operation is completed, succeeding color copying operation is started upon a print switch 19 is turned on. Firstly, an electrostatic latent image to be developed by magenta toner is formed on the photoconductive drum 8 by the optical system 3. This electrostatic latent image is developed by the developing unit 4 using magenta toner, and the toner image obtained by this development is transported to the transfer charger 10.

On the other hand, a transfer material T is fed from the paper feed cassette C and is held on the transfer drum 9 after passing through the timing roller device 22. The transfer material T held thereat is rotatively conveyed in the direction of arrow B together with the transfer drum 9 at an equal velocity of the photoconductive drum 8. The tip of magenta toner image formed on the photoconductive drum 8 and the tip of the transfer material T on the transfer drum 9 coincide with each other at the location of the transfer charger 10 and the image is transferred on the transfer material T thereafter.

In this manner, electrostatic latent images to be developed by cyan toner, yellow toner and black toner are successively formed on the photoconductive drum 8 by the optical system 3. These electrostatic latent images are successively developed by the developing units 5,6,7 every time when respective images are formed, and finally each toner image by cyan, yellow and black are produced respectively. Each colored toner image produced by this developing procedure is successively transferred onto the transfer material T on the transfer drum 9 from the photoconductive drum 8 by overlaying on top the other. The transfer material T on which toner images in different colors are repeatedly and multiplicatively transferred is transported to the fixing rollers 11,12 by the transfer belt 23 after it is released from the transfer drum 9. The toners on the transfer material T is melted together thereat into predetermined colors and the image is fixed on the transfer material T. After the fixing process, the transfer material T is discharged onto the discharge tray E by the discharge rollers G.

Every time when the toner images obtained by each developing units 4,5,6 and 7 are transferred onto the transfer material T on the transfer drum 9, the residual toner on the photoconductive drum 8 is scraped by the cleaning blade 14 of the cleaning device 140 into a cleaner housing 13 and is accommodated in an unillustrated collection box. The charge remained on the photoconductive drum 8 is erased by the eraser 21 to be ready for next process.

The operation of the control circuit 15 for controlling a series of the above described action of the copying machine will now be described below with reference to FIGS. 2 and 3.

Figure 2:
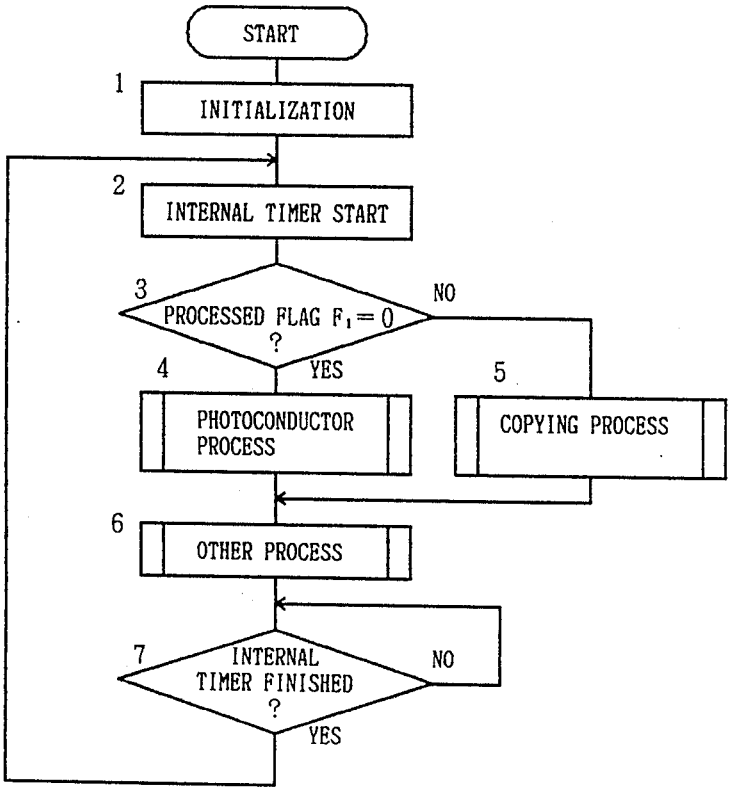
FIG. 2 is a flow chart showing a main routine of control by a control circuit of the copying machine illustrated in FIG. 1.
Figure 3:
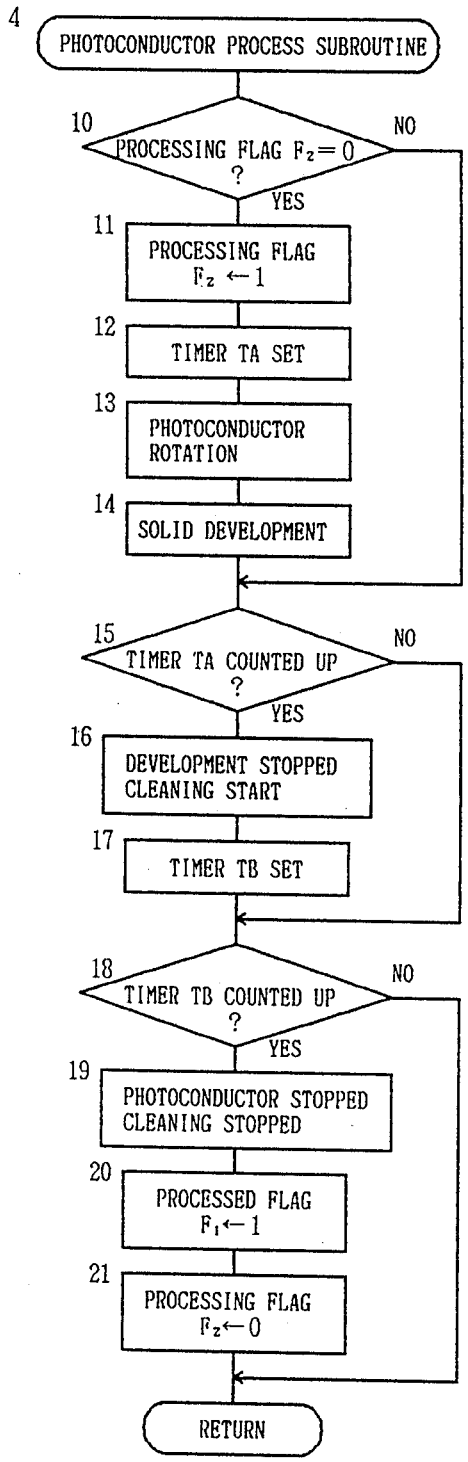
FIG. 3 is a flow chart showing a subroutine of cleaning process for photoconductor.

FIG. 2 shows the main routine of control by the control circuit 15. According to this routine, an initialization is set at step #1 when the power source of the copying machine is turned on or when the program is returned after the trouble such as jamming is cleared. Then, an internal timer is started at step #2. The internal timer is arranged for determining the length of the main routine and the value is set in advance at step #1 when initialization is set. At step #3, judgement is made whether flag $F_1$ which indicates the completion of cleaning operation of the photoconductive drum 8 is '0' or not. The flag $F_1$ is set at '0' when initialization is made at step #1. If the flag $F_1$ is '0' at step #3, a subroutine for processing photoconductor (cleaning process) to be described later is called at step #4. If the flag $F_1$ is '1', a copying process subroutine for conducting ordinary copying operation is called at step #5. As this copying process subroutine is known well by the conventional copying machine, description on the subroutine will be omitted. After other process are conducted at step #6, one cycle of routine is finished at step #7 with time limit of the internal timer. By utilizing the length of time set for one cycle of this routine, various timers appearing in various subroutine are counted.

A photoconductor processing subroutine will be described below referring to FIG. 3.

In this routine, judgement is made whether flag $F_2$ which indicates the cleaning of the photoconductor 8 is being processed is '0' or not at step #10. The flag $F_2$ is also set at '0' when initialization is set at step #1. If the flag $F_2$ is '0' at step #10, the flag $F_2$ is set at '1' at step #11 and timer TA is set at step #12. The time set by timer TA is the time sufficient enough for forming solid image on the photoconductive drum 8 by black toner. Then, the photoconductive drum 8 is rotated at step #13, and solid development by black toner is carried out at step #14. If the flag $F_2$ is '1' at step #10 or when solid development by black toner is finished at step #14, judgement is made whether timer TA is up or not at step #15. If the timer TA is counted up, the developing operation is stopped and cleaning process is started at step #16, then timer TB is set at step #17.

If the timer TA is not counted up or steps #16 and #17 are passed through after timer TA is set at step #15, the program proceeds to step #18. The time set by timer TB is the time sufficient enough for cleaning solid image of black toner on the photoconductive drum 8. At step #18, judgement is made whether the timer TB is counted up or not, and if the time is counted up, cleaning operation is stopped at step #19 and flag $F_1$ is set at '1' and flag $F_2$ is reset at '0' (step #20 and #21).

According to the embodiment described above, the photoconductive drum 8 is cleaned by the solid development by black toner and the cleaning process until the warming-up time in the fixing rollers 11,12 is completed after the power source switch 18 is turned on, and even if there is a matter such as filming adhered to the photoconductive drum 8 by colored toners other than black toner, it will be removed.

The present invention is not limited to the embodiment described above and may be applied to various modes. Particularly, in place of the solid development by black toner and the cleaning process which follows, it may be considered to carry out the cleaning operation after a series of copying operation is conducted wherein the total number of copy sheets have exceeded a predetermined number or before or after the copying operation is conducted.

In case when the cleaning process is conducted after a series of copying operation is completed wherein the total number of copy sheets have exceeded a predetermined number, it may be considered to carry out the solid development and cleaning process when the number of printing sheets have exceeded, for instance, 100 sheets of paper.

Figure 4:
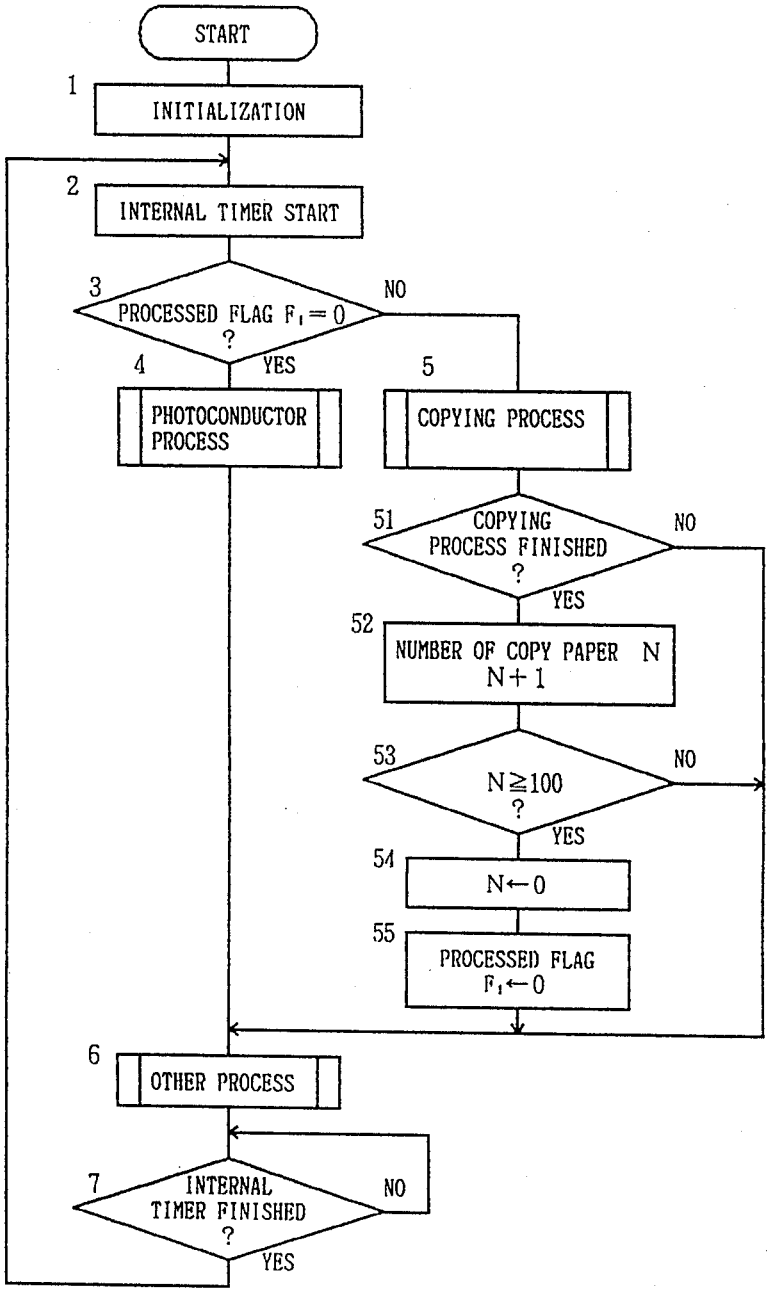
FIGS. 4 and 5 are flow charts each showing actions of the color copying machine in other embodiments.

If such process under which the cleaning process is conducted every 100 sheets of paper is described as a second embodiment of the present invention, the main routine of control by the control circuit 15 comes as illustrated in FIG. 4.

In the flow chart of FIG. 4, N represents the number of printing sheets. In this case, the number of sheets copied so far are read from non-volatile memory at step #1 of initialization, and when the copying operation at step #5 is completed (step #51), the number of sheets copied are counted at step #52. When the number of sheets reach 100 sheets (step #53), the counter is cleared '0' at step #54, and flag $F_1$ is reset '0' at step #55. In this case, the flag $F_1$ is set '1' at initialization (step #1).

It may be arranged to carry out solid development by black toner and the cleaning process every time when successive copying operation is conducted since copying efficiency is largely lowered if the photoconductive drum 8 is developed by black toner followed by cleaning process before or after every copying operation is conducted.

Figure 5:
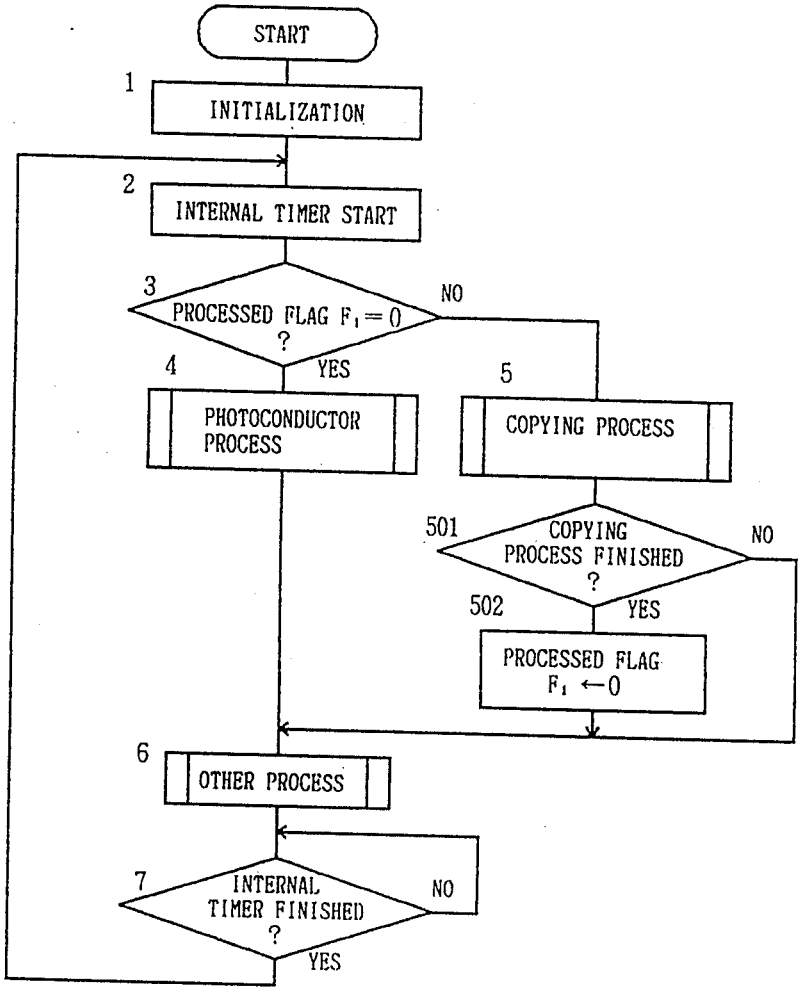

If the case when cleaning process is conducted after printing is over or at the time of printing is described as third embodiment of the present invention, the main routine of control by the control circuit 15 comes as illustrated in FIG. 5. In this case, flag $F_1$ is set at '1' at step #1 of initialization and when copying operation is finished at step #5 (step #501), the flag $F_1$ is reset '0' at step #502. The flag $F_1$ thus reset at '0' is set "1" at step #20 of photoconductor process subroutine shown in FIG. 3.

In an apparatus described in the above embodiment, the so-called positive-to-positive method is disclosed wherein an image is formed by using a toner negatively charged against the electrifying polarity of charger, however, the so-called negative-to-positive method can also be applied to the present invention wherein an image is formed by a toner positively charged against the electrifying polarity of charger. However, when a solid image is to be formed in an apparatus to which the negative-to-positive method is applied, black developing unit is operated under a state the charger is turned off.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. In a method for controlling an image forming apparatus which is provided with a plurality of developing means for accommodating different kinds of developers for developing electrostatic latent image formed on a photoconductor to form an image, the method comprising the steps of:

counting the number of image forming process; and prohibiting image forming operation when the counted number of image forming process has reached a predetermined value, and executing the following three steps of, (1) sticking a predetermined kind of developer to the photoconductor by use of a predetermined developing means without forming electrostatic latent image on the photoconductor, (2) removing the developer from the photoconductor by a cleaning means, and permitting image forming operation after the above two steps are executed.

2. The method as defined in claim 1, wherein the predetermined kind of developer contains abrasives.

3. The method as defined in claim 1, further comprising the step of electrifying the photoconductor by use of a charging means before said sticking step.

4. In a method for controlling an image forming apparatus which is provided with a plurality of developing means for accommodating different kinds of developers for developing electrostatic latent image formed on a photoconductor to form an image, the method comprising the steps of:

judging the completion of image forming operation;

executing the following three steps when image forming operation is finished, (1) sticking a predetermined kind of developer to the photoconductor by use of a predetermined developing means without forming electrostatic latent image on the photoconductor, (2) removing the developer from the photoconductor by a cleaning means, and permitting image forming operation after the above two steps are executed.

5. The method as defined in claim 3, wherein the predetermined kind of developer contains abrasives.

6. The method as defined in claim 4, further comprising the step of electrifying the photoconductor by use of a charging means before said sticking step.

7. In a method for controlling an image forming apparatus which is provided with a means for forming electrostatic latent image on a charged photoconductor, a plurality of developing means for accommodating different kinds of developers for developing the electrostatic latent image to form an image, a means for transferring a developed image on a recording media and a means for removing the developer remained on the photoconductor, the method comprising the steps of:

(1) sticking a predetermined kind of developer to the photoconductor by use of a predetermined developing means without forming electrostatic latent image on the photoconductor; and (2) removing the developer from the photoconductor by a cleaning means without operating the transfer means.

8. The method as defined in claim 7, further comprising the step of electrifying the photoconductor by use of a charging means before said sticking step.

9. The method as defined in claim 7, wherein the steps (1) through (2) are executed in response to the application of power source.

10. The method as defined in claim 9, further counting the number of sheets on which image is formed, wherein the steps (1) through (2) are executed when the number of sheets on which image is formed have reached a predetermined value.

11. The method as defined in claim 7, wherein the steps (1) through (2) are executed when image forming operation is finished.

12. The method as defined in claim 7, wherein the predetermined kind of developer contains abrasives.

13. A colored image forming apparatus, comprising:

a photoconductor having endless photoconductive surface and is rotatively driven in a predetermined direction;

an electrostatic latent image forming means for forming electrostatic latent image on the photoconductor;

a plurality of developing means for accommodating different colored developers to form electrostatic latent image by supplying each colored developer to the photoconductor, wherein at least one of the developing means accommodate black developer;

a transfer means for transferring an image developed by the developer on the photoconductor onto a recording media;

a cleaning means having a blade which is pressed to come in contact with the photoconductor to remove residual developer on the photoconductor being rotated; and a control means for operating the developing means which accommodates black developer without operating the electrostatic latent image forming means and the transfer means to stick black developer onto the photoconductor, and the black developer stuck to the photoconductor is removed from the photoconductor by the cleaning means.

14. The colored image forming apparatus as defined in claim 13, further comprising means for electrifying the photoconductor, wherein said control means operates said electrifying means.

15. The colored image forming apparatus as defined in claim 14, wherein the black developer contains abrasives.

16. An image forming apparatus, comprising:

a photoconductor having endless photoconductive surface and is rotatively driven in a predetermined direction;

an electrostatic latent image forming means for forming electrostatic latent image on the charged photoconductor;

a plurality of developing means for accommodating different kinds of developers to form electrostatic latent image by supplying each colored developer to the photoconductor;

a transfer means for transferring an image developed by the developer on the photoconductor onto a recording media;

a cleaning means for removing residual developer from the photoconductor; and a control means for operating the developing means which accommodates a predetermined kind of developer without operating the electrostatic latent image forming means and the transferring means to stick the predetermined kind of developer onto the photoconductor when power source is applied, and the predetermined developer adhered to the photoconductor is removed by the cleaning means.

17. The image forming apparatus as defined in claim 16, wherein said electrostatic latent image forming means comprises a charging means for charging the photoconductor and an exposure means for exposing an image light onto the charged photoconductor, and said control means inhibiting the operation of said exposure means but allowing the operation of said charging means.

18. The image forming apparatus as defined in claim 17, wherein the control means operates the developing means which accommodates a predetermined kind of developer for a predetermined period of time.

19. The image forming apparatus as defined in claim 18, wherein the predetermined kind of developer is black.

20. The image forming apparatus as defined in claim 18, wherein the predetermined kind of developer contains abrasives.

21. An image forming apparatus, comprising:

a photoconductor having endless photoconductive surface and is driven in a predetermined direction;

a charging means for electrifying the photoconductor;

an electrostatic latent image forming means for forming an electrostatic latent image on the charged photoconductor;

a plurality of developing means for accommodating different colored developers to form electrostatic latent image by supplying each developer to the photoconductor;

a transfer means for transferring an image developed by the developer on the photoconductor onto a recording media;

a heat fusing means for fusing the developer transferred onto a recording media;

a cleaning means for removing residual toner from the photoconductor; and a control means for sticking black developer onto the photoconductor wherein warm-up process is started for making the heat fusing means to be ready for operation when power source is applied, and during the warm-up process, the charging means and the developing means which accommodates a predetermined developer are operated without operating the electrostatic latent image forming means and the transfer means, and the black developer adhered to the photoconductor is removed by the cleaning means.

22. The image forming apparatus as defined in claim 21, wherein the predetermined kind of developer is black.

23. The image forming apparatus as defined in claim 21, wherein the predetermined kind of developer contains abrasives.

24. An image forming apparatus, comprising:

an image forming means;

a photoconductor;

an electrostatic latent image forming means for forming electrostatic latent image on the photoconductor;

a plurality of developing means for sticking developer onto the photoconductor to form a visible image, and each means sticks different kind of developer to the photoconductor;

a transfer means for transferring an image developed on the photoconductor onto a recording media;

a cleaning means for removing residual toner from the photoconductor;

a counting means for counting the number of times of image formation; and a control means for sticking a predetermined kind of developer onto the photoconductor by operating a predetermined developing means without operating the electrostatic latent image forming means and the transfer means when the number of value counted by the counting means reached a predetermined value.

25. The image forming apparatus as defined in claim 24, wherein the predetermined kind of developer is black.

26. The image forming apparatus as defined in claim 24, wherein the predetermined kind of developer contains abrasives.

27. A colored image forming apparatus, comprising:

a photoconductor having endless photoconductive surface and is rotatively driven in a predetermined direction;

a charging means for electrifying the photoconductor;

an electrostatic latent image forming means for forming electrostatic latent image on the charged photoconductor;

a plurality of developing means for accommodating different colored developers to develop electrostatic latent image by supplying each developer to the photoconductor;

a transfer means for transferring an image developed by a developer on the photoconductor onto a recording media;

a cleaning means having a blade pressed to the photoconductor for removing residual developer from the photoconductor being rotated; and a control means for sticking black developer onto the photoconductor by operating a developing means which accommodates black developer without operating the electrostatic latent image forming means and the transfer means, and the black developer adhered to the photoconductor is removed by the cleaning means.

28. The colored image forming apparatus as defined in claim 27, wherein the predetermined kind of developer is black.

29. The colored image forming apparatus as defined in claim 27, wherein the predetermined kind of developer contains abrasives.

* * * * *